US008943654B2

(12) United States Patent
Steinbach et al.

(10) Patent No.: US 8,943,654 B2
(45) Date of Patent: Feb. 3, 2015

(54) CLOTHING CARRIER FOR CLOTHING FOR PROCESSING FIBER MATERIAL

(71) Applicant: Graf +Cie AG, Rapperswil (CH)

(72) Inventors: Günter Steinbach, Reutlingen (DE); Peter Artzt, Reutlingen (DE); Volker Jehle, Öhningen (DE)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 13/908,277

(22) Filed: Jun. 3, 2013

(65) Prior Publication Data

US 2014/0020211 A1 Jan. 23, 2014

(30) Foreign Application Priority Data

Jun. 4, 2012 (CH) ..... 00764/12

(51) Int. Cl.
*D01G 15/86* (2006.01)
*D01G 15/14* (2006.01)

(52) U.S. Cl.
CPC ..... *D01G 15/14* (2013.01); *D01G 15/86* (2013.01)
USPC ..... 19/114

(58) Field of Classification Search
CPC ..... D01G 1/84; D01G 1/86; D01G 15/84; D01G 15/86
USPC ..... 19/114
See application file for complete search history.

(56) References Cited

U.S. PATENT DOCUMENTS

| | | | | | |
|---|---|---|---|---|---|
| 1,293,504 | A | * | 2/1919 | Midgley | 19/114 |
| 1,773,783 | A | | 8/1930 | Midgley | |
| 2,488,442 | A | * | 11/1949 | Snape, Jr. | 19/114 |
| 2,619,683 | A | | 12/1952 | Murray | |
| 3,058,168 | A | * | 10/1962 | Laroche | 19/114 |
| 3,290,729 | A | * | 12/1966 | Maynard | 19/114 |
| 3,947,922 | A | * | 4/1976 | Ibbotson | 19/114 |
| 4,100,006 | A | * | 7/1978 | Buckley | 156/78 |
| 4,356,598 | A | * | 11/1982 | Graf | 19/114 |
| 4,594,284 | A | * | 6/1986 | Nakagawa et al. | 442/214 |
| 5,067,203 | A | * | 11/1991 | Hollmann | 19/114 |
| 6,070,302 | A | * | 6/2000 | Graf | 19/114 |
| 6,170,124 | B1 | | 1/2001 | Graf | |
| 8,003,554 | B2 | | 8/2011 | Saeger et al. | |
| 8,186,390 | B2 | * | 5/2012 | Krishnaswamy et al. | 139/420 A |

(Continued)

FOREIGN PATENT DOCUMENTS

| | | |
|---|---|---|
| DE | 132788 | 5/1916 |
| JP | 60259635 | 12/1985 |
| JP | 61225333 | 10/1986 |

OTHER PUBLICATIONS

Swiss Patent Office Search Report, Sep. 3, 2012.

*Primary Examiner* — Shaun R Hurley
(74) *Attorney, Agent, or Firm* — Dority & Manning, P.A.

(57) ABSTRACT

The invention relates to a clothing carrier (3) for flexible or semi-rigid clothings (2) for processing fiber material, wherein the clothing carrier (3) has a longitudinal direction (6) and a transverse direction (7). The transverse direction (6) corresponds to a working direction (A) of the clothing (2). The clothing carrier (3) exhibits a maximum tensile force ($F_L$) in the longitudinal direction (6) which is greater than a maximum tensile force ($F_Q$) in the transverse direction (7).

7 Claims, 1 Drawing Sheet

(56) References Cited

U.S. PATENT DOCUMENTS 8,192,317 B2 * 6/2012 Lee et al. ..... 474/267
2008/0119101 A1 * 5/2008 Lee et al. ..... 442/203
2012/0009405 A1 * 1/2012 Krishnaswamy et al. .... 428/219

* cited by examiner

CLOTHING CARRIER FOR CLOTHING FOR PROCESSING FIBER MATERIAL

FIELD OF THE INVENTION

The present invention relates to a clothing carrier for flexible or semi-rigid clothings for processing fiber material.

BACKGROUND

Flexible and semi-rigid clothings are used in different areas of processing textile fibers such as opening or carding fiber material. A flexible or semi-rigid clothing consists substantially of a clothing carrier and the clothing tips. The clothing tips are formed by wire hooks which are U-shaped. In a so-called setting process, the wire hooks are pierced through the clothing carrier at certain distances and in certain arrangements, wherein the ends of the wire hooks protrude out of the clothing carrier and form the clothing tips. The number of clothing tips per unit of area is designated as tip density. The wire hooks are held in the clothing carrier and, depending on their shape and length, as well as on the condition of the clothing carrier, have a certain flexibility. Semi-rigid clothings have stronger wire hooks than the flexible clothings. Likewise, in the case of semi-rigid clothings, the clothing carrier is designed to be stronger in the sense of less flexible than in the case of flexible clothings. From the prior art, a variety of flexible and semi-rigid clothings is known which differ in terms of shape, material and arrangement of the individual clothing tips and clothing carriers. The clothings are mostly used in the form of clothing strips which are fastened on plane surfaces of so-called flats.

From the prior art, different embodiments of clothing carriers are known, wherein they usually are implemented in multiple layers. Known clothing carriers are formed as a fabric composite consisting of a plurality of woven textile layers. Clothing carriers made from a nonwoven or a combination of woven textile layers and nonwoven layers are also used in clothings.

All embodiments of clothings have in common the arrangement of the clothing tips for a certain working direction. The fiber material to be processed is fed past the clothing in a certain direction and thereby processed by the clothing. During operation, the clothing tips are subjected to a force in a predefined direction. This direction of force that is designated as working direction results in a temporary deformation of the wire hooks. According to the arrangement and the elasticity of the clothing carrier, the wire hooks are also moved within the clothing carrier resulting in wear on the clothing carrier. Due to the continuously increasing output of textile machines, the load acting on the deployed clothings has increased as well.

For example, the development in the field of cards has resulted in a high-performance card that achieves a multiple of the production output of older machines. This resulted also in an increase of the carding forces occurring between the tambour and the processing element. The carding forces are generated between the clothing of the tambour and the clothing of a processing element. The working direction of a clothing, and thus the direction in which the carding forces act, corresponds to the movement direction of the fiber material transported by the clothing of the rotating tambour. The processing elements are typically implemented as so-called flats which are distributed over the circumference of the tambour at a certain distance from each other. On the side facing toward the tambour, the flats are provided with clothings in the form of clothing strips. The strips have a greater length in the axial direction of the tambour. Thus, the longitudinal direction of the clothing strip or, respectively, the clothing carrier corresponds to the axis of the tambour. The transverse direction of the clothing strip or, respectively, the clothing carrier extends perpendicular to the longitudinal direction. The transverse direction of the clothing carrier thus corresponds to the working direction of a clothing.

Determining the working direction of the clothing and thus of the transverse direction is important because the clothing is loaded by the occurring carding forces even in this direction. In order to obtain good carding, the clothing should have limited flexibility in the working direction and should nevertheless be fixed through the clothing carrier. This means, the clothing should not lose stability caused by a continuous movement within its flexibility during the carding process; rather, a durable constant flexibility is to be ensured.

The increased load on the clothing carrier has been addressed in the prior art by improving the construction of the clothing. For example, EP 1 020 548 A2 discloses a clothing in which the clothing carrier is reinforced through a thickening toward the clothing tips. Through this, the wire hooks are anchored in the clothing carrier with at least the same length as they protrude out of the clothing carrier for forming the clothing tips. Through this type of anchoring of the wire hooks, the free length of the clothing needles that protrudes beyond the clothing carrier and that is decisive for the movability of the wire hooks is shortened. As a result, the application possibilities are limited.

Another embodiment for reinforcing the anchoring of the wire hooks is disclosed in CH 700 925 B1. It is proposed therein to embed a reinforcement insert into the clothing carrier so as to enable undisturbed swinging of the clothing wires with an adequately strong anchoring of said wires. The disadvantage is that different layers or materials have to be used resulting in a costly embodiment of the clothing carrier.

SUMMARY OF THE INVENTION

It is an object of the invention to provide a clothing carrier which permits a flexible anchoring of the clothing according to the requirements and which has a strength for a wear-resistant anchoring that is adapted to the occurring forces. Objects and advantages of the invention are set forth in part in the following description, or may be obvious from the description, or may be learned through practice of the invention.

In accordance with the invention, a clothing carrier for flexible or semi-rigid clothings for processing fiber material is proposed, wherein the clothing carrier has a longitudinal direction and a transverse direction. The transverse direction corresponds to a working direction of the clothing. The clothing carrier exhibits a maximum tensile force in the longitudinal direction which is greater than a maximum tensile force in the transverse direction.

An improvement of the anchoring of the wire hooks in the clothing carrier is achieved by reinforcing the clothing carrier. However, reinforcing through a simple densification of the clothing carrier or by making the clothing carrier from a material with a higher stiffness counteracts the required flexibility. The clothing tips are deformed by the forces acting in the working direction of the clothing, which has to be absorbed via the flexibility (elasticity) of the clothing carrier. Principally, the strengths of a clothing carrier in their longitudinal or transverse direction are different due to the structural configuration from individual fibers or yarns, wherein yarns are also used in the form of twisted yarns. Determining the strengths in the longitudinal and transverse directions is carried out by measuring the so-called maximum tensile force. When determining the maximum tensile forces, amongst experts, a differentiation is made between test methods for fabrics and test methods for nonwovens. The test method for fabrics takes place according to the Standard DIN EN ISO 13934-1 and the test method for nonwovens according to the Standard DIN EN 29073 part 3.

In order to improve the anchoring of the clothings in the working direction thereof it is required to strengthen the anchoring of the wire hooks by fibers or yarns lying transverse to the direction of force. The fibers or yarns lying transverse to the direction of force or movement direction of the clothings are decisive for the holding force of the clothings. These fibers or yarns lying transverse to the direction of force extend in the longitudinal direction of the clothing carrier and accordingly determine the maximum tensile force in the longitudinal direction of a clothing carrier. In order to achieve a desired flexibility of the anchoring of the clothings, a connection of these fibers or yarns lying transverse to the direction of force is to be implemented adequately weaker in the direction transverse thereto. Accordingly, for anchoring clothings, a clothing carrier should exhibit a maximum tensile force in the longitudinal direction which is greater than a maximum tensile force in the transverse direction thereof. Through this, a wear-resistant anchoring of the clothings is achieved in the direction of force while the required flexibility is achieved at the same time.

The result of this finding is that the ratio of the maximum tensile force in the longitudinal direction of the clothing strips to the maximum tensile force in the transverse direction of the clothing strips has to be in a range of from 1.2 to 3.0 so as to achieve the best possible anchoring of the clothings. Advantageously, the range between 1.5 and 2.5 for the ratio between the maximum tensile forces is to be targeted.

A woven textile layer usually consists of a composite of warp threads and weft threads extending perpendicular thereto. Due to the nature of the weaving process, warp threads and weft threads have different strengths. When using one or a plurality of woven textile layers for building up a clothing carrier, for production-related reasons, the warp thread is a twisted yarn, but the weft thread is not. The woven textile layers are usually sheeted in such a manner that the warp threads lie in the transverse direction and the weft threads in the longitudinal direction of the clothing carrier. Without further intervention, this will result in a maximum tensile force in the longitudinal direction of the clothing carrier which is lower than the maximum force in the transverse direction of the clothing carrier. Remedy can be provided by increasing the thread density in the weft direction or by using yarn of higher quality as weft threads.

When using a nonwoven for a clothing carrier, the buildup is carried out from individual fibers. Through the arrangement, the number or the type of fibers used in the transverse and longitudinal directions, the strength of the clothing carrier can be influenced in both directions.

Advantageously, the maximum tensile force of a clothing carrier in the longitudinal direction is between 2,000 N and 4,000 N and in the transverse direction between 1,000 N and 2,000 N. Determining the maximum tensile forces is carried out for fabrics and woven textile layers according to the Standard DIN EN ISO 13934-1 and for nonwoven according to the Standard DIN EN 29073 part 3.

In a further embodiment, the required strengths in the longitudinal and transverse directions of the clothing carrier are achieved by using a reinforcement layer. Reinforcement layers are possible in many different constructions, for example, as a grid or wires. The reinforcement layers can also be attached on the upper or lower sides of the clothing carrier and are not necessarily to be inserted between the layers of the clothing carrier.

Producing clothing carriers from a nonwoven strengthened through needling and impregnating as well as producing clothing carriers from a fabric composite comprising a plurality of woven textile layers is known from the prior art.

The strength ratios between the maximum tensile force in the longitudinal direction and the maximum tensile force in the transverse direction can also be achieved by using reinforcement inserts. The reinforcement inserts are to be selected according to the required strength ratios.

The invention is explained hereinafter based on an exemplary embodiment and is illustrated in more detail through drawings.

DETAILED DESCRIPTION

Figure 1:
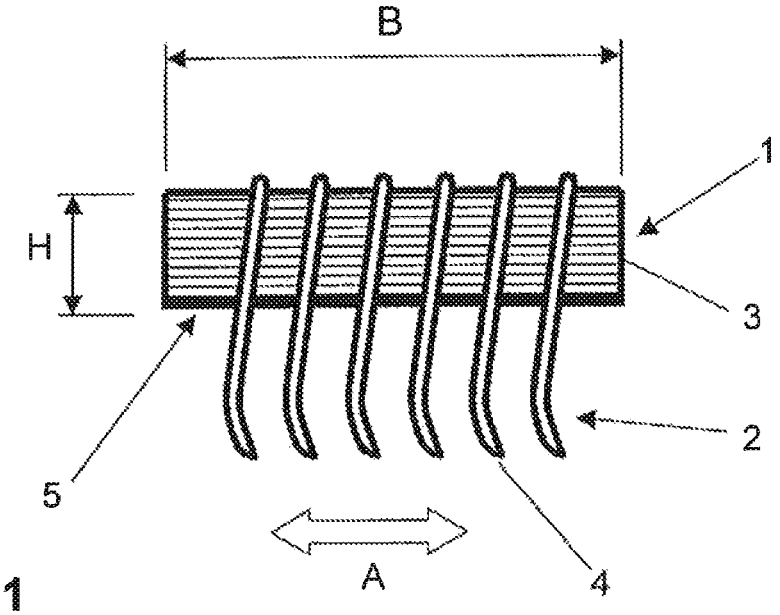
FIG. 1 shows a schematic illustration of a cross-section of a clothing strip with a flexible clothing.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

FIG. 1 schematically illustrates a known clothing strip 1 made from a clothing carrier 3 with an inserted flexible clothing 2. The clothing carrier 3 is composed of a plurality of woven textile layers so as to form a fabric composite. The individual woven textile layers are held together through binding agents or by vulcanizing with rubber or synthetic rubber. Instead of the shown woven textile layers, a construction consisting of one or a plurality of nonwoven materials is also known. On the side of the clothing 2, usually a cover layer or a coating 5 is attached on the clothing carrier 3. This coating 5 serves for improving the surface properties with regard to dirt repellency and fiber friction. The wire hooks 4 that are pierced through the clothing carrier 3 are held in the clothing carrier 3 and form the clothing 2 with their tips protruding out of the clothing carrier 3. The wire hooks 4 are highly loaded during the operation and are adequately anchored in the multi-layer clothing carrier 3. The load acting on the wire hooks 4 takes place during the use of the clothing strip 1 in the working direction A of the clothings 2. As shown in FIG. 1, the working direction A can act counter to or with the wire hooks 4, depending on the field of application and function of the clothings 2. However, the working direction A corresponds always to the direction of the width B of the clothing carrier 3. Flexible clothings 2 as well as semi-rigid clothings are mainly manufactured in strips with a given width B and a length L and are inserted in so-called flats. The height H of such a clothing carrier 3 likewise depends on the field of application and the required anchoring of the clothing 2.

Figure 2:
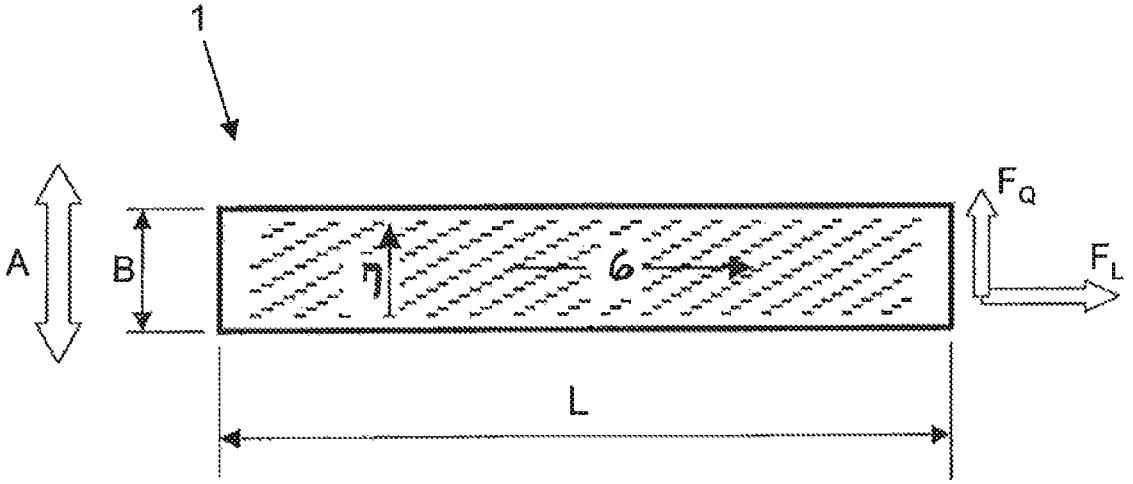
FIG. 2 shows a schematic illustration of an embodiment of a clothing strip.

FIG. 2 schematically illustrates an embodiment of a clothing strip 1. FIG. 2 shows a clothing carrier 3 in the form of a frequently used clothing strip 1 with a width B and a length L. The wire hooks 4 that are pierced through the clothing carrier 3 are visible with their backs opposite to the clothing tips. The clothing strips 1, and thus also the clothing carrier 3, have a longitudinal direction 6 and a transverse direction 7, wherein the transverse direction 7 of the clothing strip 1 or, respectively, the clothing carrier 3 corresponds to the working direction A of the clothing. The force application on the clothing takes place in the working direction and thus in the transverse direction 7 of the clothing carrier 3.

The clothing carrier 3 exhibits a maximum tensile force $F_L$ in the longitudinal direction 6 and a maximum tensile force $F_Q$ in the transverse direction. In terms of its technical properties, the clothing carrier 3 is configured such that the maximum tensile force $F_L$ in the longitudinal direction 6 is greater than the maximum tensile force $F_Q$ in the transverse direction.

Modifications and variations can be made to the embodiments illustrated or described herein without departing from the scope and spirit of the invention as set forth in the appended claims.

The invention claimed is:

1. A clothing for processing fiber material, comprising:

a clothing carrier;

a plurality of wire hooks penetrating through the clothing carrier, the hooks having tips protruding from the clothing carrier;

the clothing carrier having an operational longitudinal direction and transverse direction, wherein the transverse direction corresponds to a working direction of the clothing;

the clothing carrier having a maximum tensile force in the longitudinal direction that is greater than a maximum tensile force in the transverse direction; and wherein a ratio of the maximum tensile force in the longitudinal direction to the maximum tensile force in the transverse direction is from 1.2 to 3.0.

2. The clothing as in claim 1, wherein a ratio of the maximum tensile force in the longitudinal direction to the maximum tensile force in the transverse direction is from 1.5 to 2.5.

3. The clothing as in claim 1, wherein the maximum tensile force in the longitudinal direction is the range of 2,000 N to 4,000 N.

4. The clothing as in claim 3, wherein the maximum tensile force in the transverse direction is the range of 1,000 N to 2,000 N.

5. The clothing as in claim 1, wherein the clothing carrier includes an integrated reinforcement layer.

6. The clothing as in claim 5, wherein the clothing carrier comprises a needled and impregnated nonwowen material.

7. The clothing as in claim 1, wherein the clothing carrier comprises a fabric composite of a plurality of woven textile layers.

* * * * *